US005497760A

United States Patent [19]

Alden et al.

[11] Patent Number: 5,497,760

[45] Date of Patent: Mar. 12, 1996

[54] CONVECTION OVEN WITH POWER INDUCED BACK DRAFT FLOW

[75] Inventors: Lorne B. Alden, Shelburne; J. Timothy Cole, Essex Junction; James A. Kleva, Richmond; Erin D. Lonergan, Williston, all of Vt.

[73] Assignee: G. S. Blodgett Corporation, Burlington, Vt.

[21] Appl. No.: 324,193

[22] Filed: Oct. 17, 1994

[51] Int. Cl.[6] ..... F24C 15/32

[52] U.S. Cl. ..... 126/21 A; 126/21 R; 126/273 A

[58] Field of Search ..... 126/21 A, 21 R, 126/273 R, 273 A; 219/400, 10.55R; 99/468, 330, 331, 470, 476

[56] References Cited

U.S. PATENT DOCUMENTS

| | | | |
|---|---|---|---|
| 4,395,233 | 7/1983 | Smith et al. | 126/21 A X |
| 4,498,453 | 2/1985 | Ueda | 126/21 A |
| 4,516,012 | 5/1985 | Smith et al. | 219/400 |
| 4,627,409 | 12/1986 | Kagomoto | 126/21 A |
| 4,926,837 | 5/1990 | Parker et al. | 126/21 A X |
| 4,928,663 | 5/1990 | Nevin et al. | 126/21 A |
| 5,309,981 | 5/1994 | Binder | 126/21 A X |
| 5,361,749 | 11/1994 | Smith et al. | 126/21 A |

*Primary Examiner*—Larry Jones

*Attorney, Agent, or Firm*—Lowe, Price, Leblanc & Becker

[57] ABSTRACT

An efficient convection oven is described. The oven utilizes a single inlet centrifugal induced back draft fan disposed in a sidewall thereof between vertical burners and combustion chambers to constantly mix products of combustion from the combustion chambers with air from within the oven cavity and recirculate the same. The fan design of the instant invention permits air changes within the oven cavity in the range of 85 to 100 per minute and the vertical burner fan combustion chamber combination permits a dramatic increase in the rack space within the oven cavity for a given oven exterior envelope.

10 Claims, 5 Drawing Sheets

FIG. 1
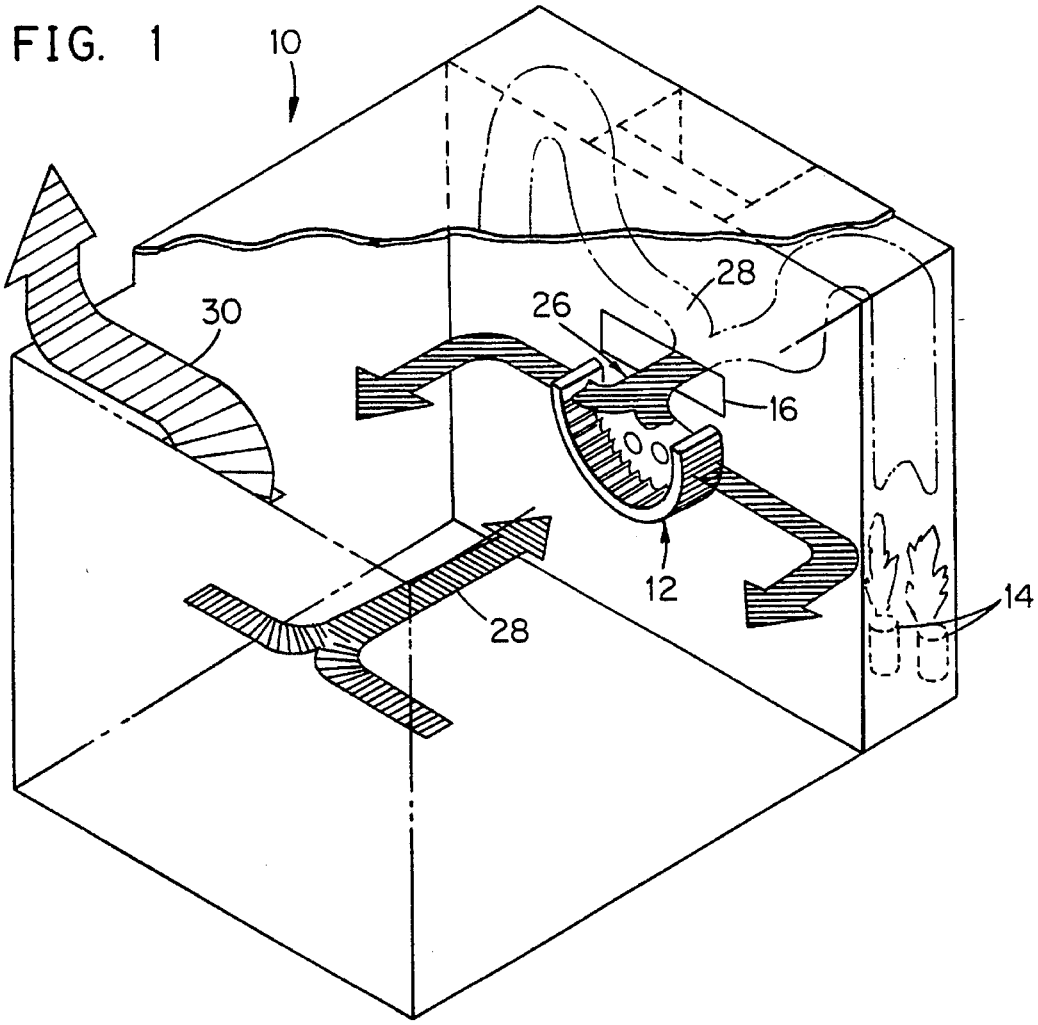
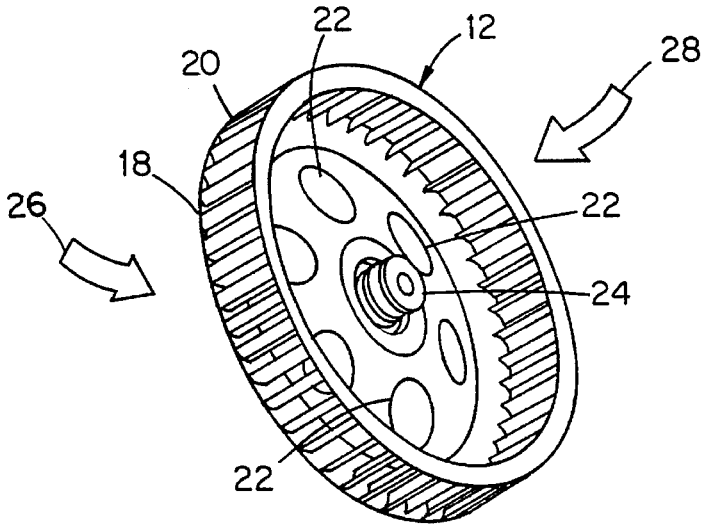
FIG. 2

CONVECTION OVEN WITH POWER INDUCED BACK DRAFT FLOW

BACKGROUND OF THE INVENTION

1. Field of the Invention

This invention relates to a gas fired cooking and heating apparatus and, in particular, to a convection oven which uses forced convection currents for uniform and efficient cooking in an economy of space.

2. Description of the Prior Art

Convection ovens which circulate convection currents within the cooking chamber or oven cavity have been well known for many years. Typically, the heat source is disposed below the oven cavity within an oven housing and the hot convection currents are continually introduced into the oven cavity by a fan.

Clearly, a most efficient convection cooking will occur when the food product is baked in uniform currents of constant or nearly constant temperature so that hot spots or cold spots will be avoided as the food is cooking.

In order to facilitate uniform cooking, U.S. Pat. Nos. 4,395,233 and 4,516,012, assigned to the Assignee of this invention, describe a dual flow oven wherein heated air from a gas burner is continually admitted into the oven cavity where it is mixed with recirculated air from within the cavity and circulated around the food to be cooked. This dual flow capability is achieved by the use of a single, special purpose fan wherein heated air from the burner is drawn into the back of the fan, air from within the oven cavity is drawn axially into the front of the fan, and the two currents are expelled radially whereby they mix in a plenum chamber and then circulate throughout the oven cavity, around the food to be cooked, on a continual basis. The fan utilized in such patents is a squirrel cage type fan wherein a plate divides the fan blades, the plate being disposed perpendicular to the axis of rotation and midway between the front and back edges of the fan blades. Radially downstream of the fan, a partition is provided along the adjacent oven wall which receives the currents expelled from the fan, causing the currents to mix, and then expels them to circulate throughout the oven cavity.

The ability to draw in heated air from the burner and air from within the oven cavity, simultaneously, axially, is achieved by, as noted above, a fan which consists of basically two sets of coaxially mounted impeller blades positioned on either side of a rotating centrally disposed circular plate. The fan provides for the forced intake of the two air streams, one flowing along the fan axis in a first direction and a second air stream flowing along the fan axis in an opposite direction, but both moving inwardly toward the center plate. In this manner the fan provides intake force for both the heated air stream from the burner and the recirculated airflow from within the heating compartment and further provides for mixing of same.

The dual flow fan is located in the heating compartment positioned between one of the walls of the heating compartment and a divider panel spaced therefrom which is provided with a central aperture for allowing the recirculated airflow to enter the dual flow fan from within the heating compartment. An aperture is provided behind the fan for admission of the heated airflow from the burner.

Prior art configurations have been found to restrict the working height of the oven cavity space which in turn limits the rack holding capacity. Specifically, the burner is typically in a chamber located extending laterally across the bottom of the oven cavity, and spaced therebelow whereby air can be taken into the oven in the space between the external housing and the oven cavity, circulated around the burner to be heated, and then directed upwardly for entry into the oven. This, in effect, then requires a substantial space between the oven cavity and the housing for location of the burner and for circulation of air to be heated around the burner.

In certain oven designs, the heated air from the burner is also circulated around the bottom, sides, and top of the oven cavity before being admitted thereinto. In such designs, a substantial air space must also be left between the oven cavity and the sides and top of the housing. This further dramatically reduces the interior rack space.

In most commercial environments, however, the space available within which to locate an oven is limited. The configuration of the external housing then is relatively fixed and it is obviously desirable to maximize the internal rack space within the oven cavity while maintaining an efficient heating capability. In the case of convection ovens then this would require minimizing air space between the external housing and the oven cavity walls.

An alternate oven design is provided in U.S. Pat. No. 4,928,663. In this device, a specially designed fan is located at the back of the oven compartment adjacent slots which admit heated air from the burner into the back of the fan. Air from within the oven cavity is drawn into the front of the fan, axially, and the combined currents are expelled by the fan, radially, to be circulated within the oven cavity. In this design, openings are provided in a plate located across the back face of the fan, which openings are registered on slots disposed in the wall above and below the rotational axis of the fan. The opposite face of the fan, facing the oven cavity, is open. Burners located below the oven cavity and within the exterior housing extend across the bottom and air is continually taken into the oven cavity circulated around the exterior of the oven cavity along the sides and top thereof to be directed through the slots in the back wall for entry into the fan. In this way, the heated air from the burner circulates around the entire exterior of the oven cavity to heat the same before being admitted through the fan into the interior thereof.

This design then has the disadvantage of restricting rack space due to the external heated air circulation pattern. Furthermore, the heated air circulating around the oven will lose heat content before entering the cavity to be circulated around the food to be cooked. Heated walls then will transmit that heat primarily by radiation to the food to be cooked whereas the primary cooking will occur by the convection currents circulating through the cavity, in contrast to those currents circulating around the exterior of the cavity.

Other types of fan arrangements in convection ovens are shown, for example, in U.S. Pat. Nos. 4,926,837 and 5,309,981.

SUMMARY OF THE INVENTION

It has been discovered, however, that an improved convection oven can be provided which maximizes the working height and, therefore, rack space within the oven cavity. The device of this invention uses a special purpose fan designed to draw air from within the air chamber into the fan axially in one direction and to draw heated outside air into the fan axially in the opposite direction whereby the two incoming streams mix in the fan, and then are expelled radially to be circulated throughout the oven cavity. This embodiment then does not include a plenum chamber downstream of the fan for mixing the two air streams. In addition, the device of this invention utilizes a vertically mounted "in-shot" type burners disposed adjacent the fan whereby heated air from the burners is directly ingested into the fan intake. This design then eliminates a horizontal burner, normally disposed below the oven cavity. By providing the burners vertically mounted adjacent the fan intake on one side, the space requirement for the oven cavity and especially the height thereof can be dramatically increased as there is no need to provide for air circulation around a burner disposed in the bottom of the oven housing, or for that matter to provide for circulating heated air around the external surface of the oven cavity. It has been found that when the heated air is directly ingested into the fan, axially, to be mixed and distributed in the oven cavity, superior convection cooking occurs.

The improved circulation characteristics of the instant invention are also based upon a unique fan design wherein a concave plate is provided on one face of the fan which plate is indented axially so that as the fan rotates, a low pressure zone will develop in the concavity. The developing pressure differential then facilitates the intake of heated air from the burners. The fan then has a single inlet with induced back draft.

Accordingly, it is an object of this invention to provide an improved convection oven in which vertical burners are provided so that the height of the oven cavity can be maximized within an existing housing design.

It is another object of this invention to provide a convection oven wherein heated air from burners is taken into a circulatory fan axially in one direction while heated air from within the oven cavity is recycled into the fan axially in an opposite direction so that the two streams are mixed by the fan and then circulated back into the oven cavity in such a manner to maximize the recirculatory flow within the oven cavity.

It is a further object of this invention to provide a convection oven having both increased rack space and circulatory characteristics whereby a single fan is used to both recirculate heated air from within the oven cavity, and to supply heated outside air from the burners.

BRIEF DESCRIPTION OF THE DRAWINGS

These and other objects will become readily apparent with reference to the drawings and following description wherein:

FIG. 1 is a perspective schematic view of the oven of this invention showing its circulatory pattern.

FIG. 2 is a perspective view of the single inlet fan with induced back draft used to circulate the heated air streams in the device of this invention.

DETAILED DESCRIPTION OF THE INVENTION

Figure 3:
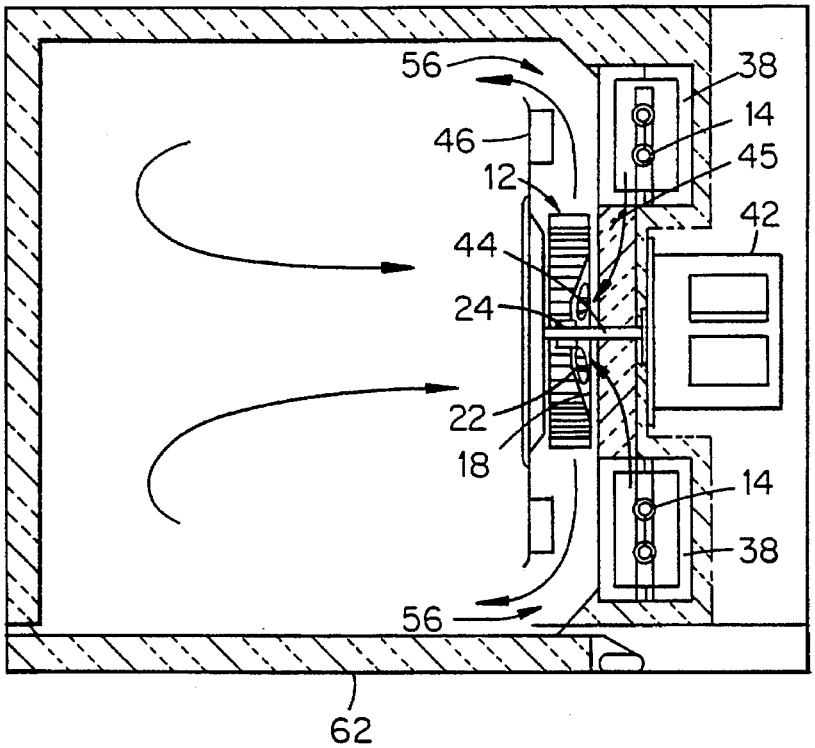
FIG. 3 is a top view in partial section of the oven of this invention.

With attention to the drawings and to FIGS. 7 A–E, respectively, there are depicted there various prior art convection oven designs. In FIG. 7A, the oven is commonly known as a "Muffle", and in this device, the heated air from a burner below the oven box is circulated around the box heating the oven walls. A conventional squirrel cage fan blows air across the inside of the oven walls extracting heat and circulating it within the oven cavity. In the embodiment of FIG. 7B, there is depicted the airflow associated with the dual flow oven described in the patents above identified and assigned to the assignee of this invention. In that design, the heated air from the burner circulates around the oven container and enters the back of the fan, axially. Air from within the oven enters the front face of the fan, axially, and the two streams are expelled radially by the fan. As noted, air from within the box is also vented and can be recycled.

Figure 7A:
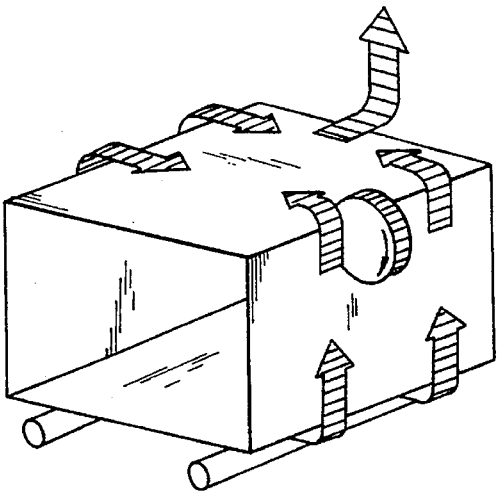
FIG. 7A PRIOR ART
FIG. 7 A–E are schematic views of prior art ovens.
Figure 7B:
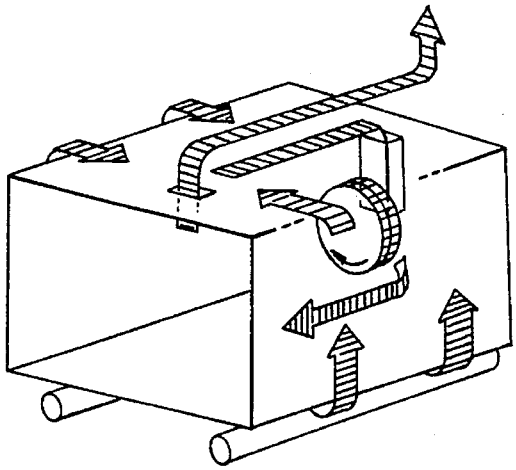
FIG. 7B PRIOR ART
Figure 7C:
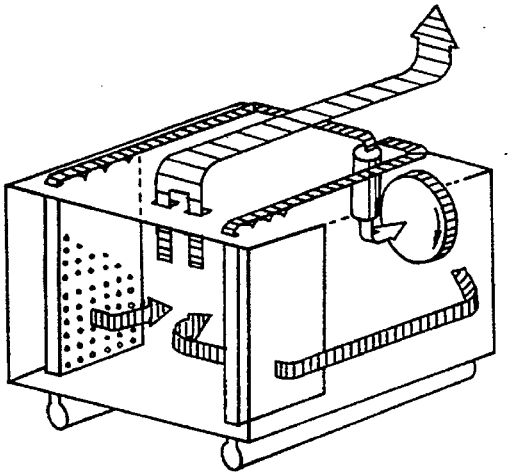
FIG. 7C PRIOR ART

FIG. 7C is commonly described as a "Snorkel" design. This also uses a burner disposed beneath the box.

Figure 7D:
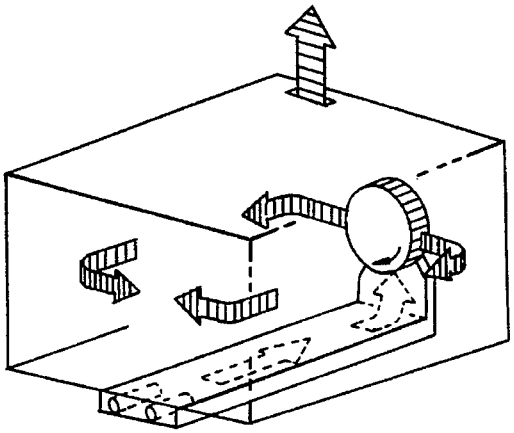
FIG. 7D PRIOR ART

FIG. 7D is an illustration of a direct fired design wherein the burners dispose below the oven box direct heated air through a duct to the fan passively by the chimney effect associated with the superheated air stream which then circulates the heated air throughout the oven cavity.

Figure 7E:
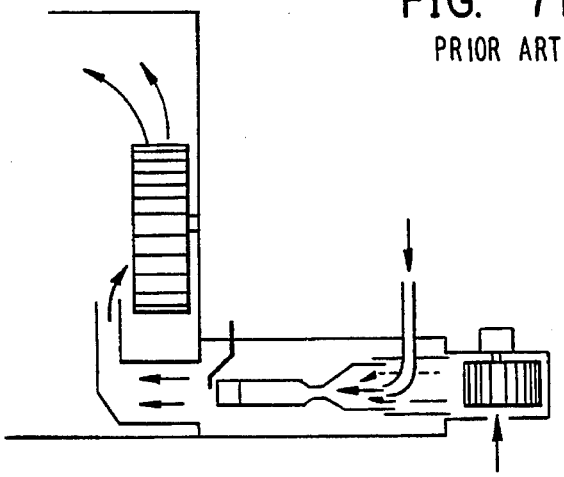
FIG. 7E PRIOR ART

Finally, FIG. 7E is a direct fired design utilizing a power burner. In that instance, the blower directs a stream of heated air, including gas, to a jet burner which in turn directs the heated products of combustion into the fire box and from there into a convectional squirrel caged fan or blower wheel in the oven cavity.

In each of these instances, as noted above, the burners are disposed horizontally and are used to supply heated outside air for circulation into the oven cavity. The designs also, in several instances, circulate this heated air around the exterior of the oven cavity so that a very substantial space will be provided between the oven cavity and the exterior housing to accommodate this airflow.

In contrast, and with attention to FIGS. 1 and 2, the oven of this invention then utilizes a single inlet, induced back draft blower wheel 12 which preferably is mounted on the side of the oven cavity. Vertical "in-shot" burners 14 are provided behind the fan and these burners direct heated air vertically to the top of the combustion chamber. The heated air is pulled down against its buoyant force through a slot 16 into the fan 12. The fan is provided with a back plate 18 which is concave in the direction of the incoming airflow of combustion products from burners 14. The axial diameter of fan 12 is substantially greater than the blade width of the blades 20.

The back plate 18 is provided with a plurality of holes 22. As the blower wheel 12 rotates about axial hub 24, a low pressure zone will be created upstream of back plate 18 by the concave portion thereof, whereby a stream of heated products of combustion 26 will be drawn actively through slot 16 against its buoyancy force, entering fan wheel 12 through holes 22. Simultaneously, an air stream 28 from within the oven cavity will be drawn into the open face of fan 12 axially whereupon the incoming streams 26 and 28 will mix in the fan 12 to be expelled radially through the blades 20 to the oven cavity.

Oven pressure within the cavity is relieved by a vent stream 30 which leaves the oven cavity via a flue (not shown) in the conventional fashion.

With attention to FIGS. 3–6, the flow within the oven cavity may be described as follows:

Twin "in-shot" burners 14 are mounted on the right side of oven 10 and disposed vertically. The burners 14 are interconnected by a fuel manifold 36 which supplies fuel such as natural gas to the burners. Combustion chambers 38 extend upwardly from the burners 14 so that products of combustion from burners 14 shoot upwardly to the ceiling 40 of the combustion chamber.

The fan 12 is disposed between combustion chambers 38 centrally located along the right side wall 45 in the oven cavity. Fan 12 is provided with a motor 42 which has a drive shaft 44 which mounts hub 24. See FIG. 3.

Figure 4:
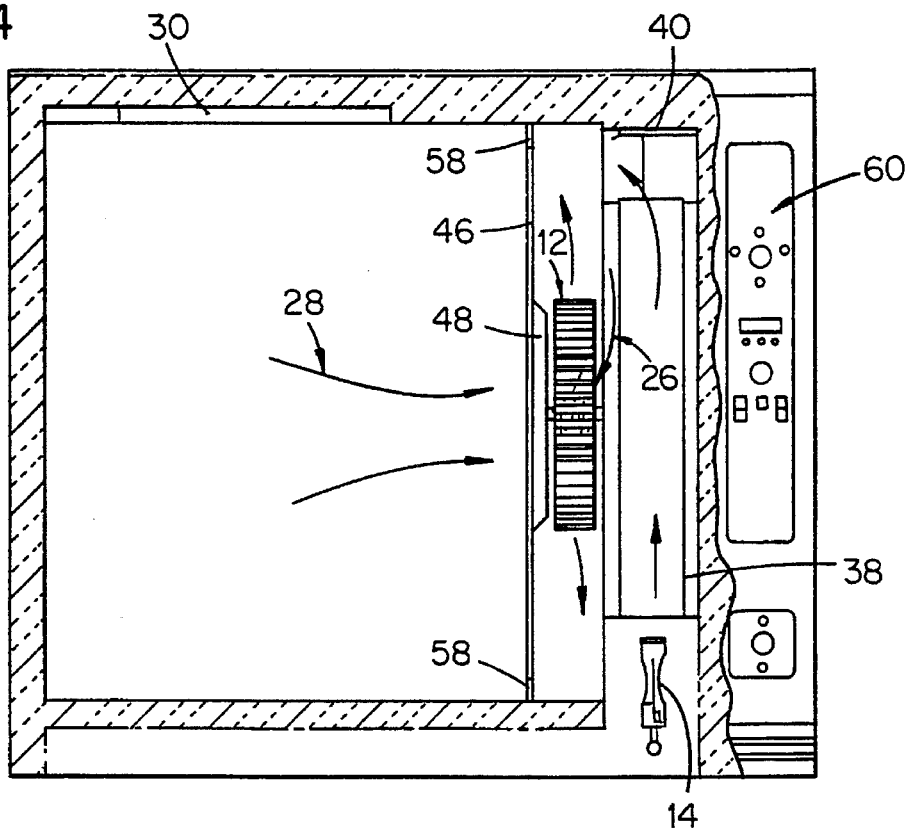
FIG. 4 is a front view in partial section of the oven of this invention.

A baffle plate 46 is disposed in front of fan 12 and is provided with a venturi inlet formed by collar 48 which surrounds the inlet opening to the fan. The drive shaft 44 from motor 42 extends through the right side wall 45 which forms an opening 50 which registers on a pair of holes 22 in back plate 18 of fan 12. During operation then the products of combustion in combustion chambers 38 are directed upwardly via their buoyant force from the burners 14 until they exit the chamber adjacent the upper portion 40 of the oven cavity. The products of combustion then are pulled downwardly by the action of fan 18 until they enter holes 22 in back plate 18. As the products of combustion enter fan 12 through back plate 18, a flow from within the oven, as shown in FIGS. 3 and 4, enters the fan through the venturi inlet 48 whereupon the two streams mix within the fan and are expelled radially as shown in FIGS. 3 and 4 behind baffle 46 to enter the oven cavity.

Figure 5:
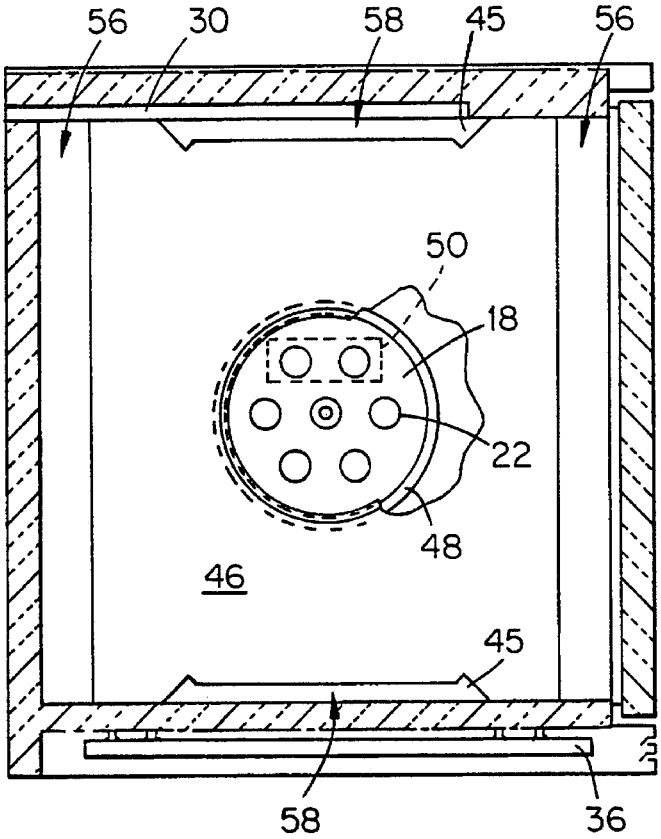
FIG. 5 is a left side view of the oven of this invention in partial section.

As shown in FIG. 5, the baffle 46 is spaced away from the front and back of the oven cavity to provide vertically extending openings 56 and similarly, openings 58 are provided above and below the fan 12 whereby the mixed air stream from fan 12 enters the oven cavity from behind baffle 46. The pulling action of fan 12 then in promoting the direction of the products of combustion also ensures ample secondary air to facilitate complete combustion of the fuel. In the absence of such a draft, incomplete combustion in the combustion chambers would occur.

Figure 6:
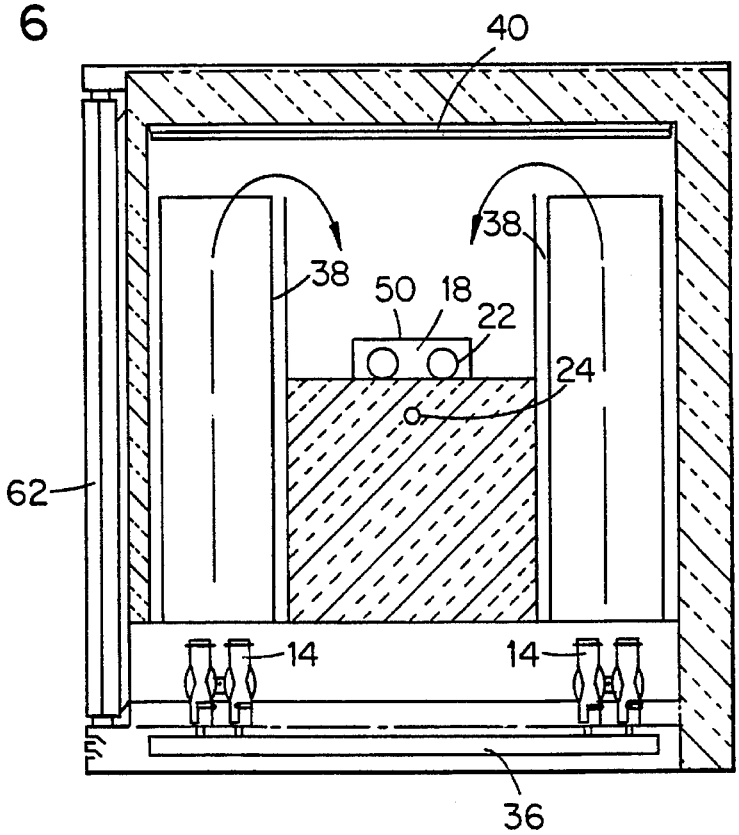
FIG. 6 is a right side view of the oven of this invention in partial section.

It should be noted that the embodiment of the invention described herein places the burners and combustion chambers as well as the single inlet centrifugal fan on the right side wall 45 of the oven 10. As shown in FIG. 4, the control panel 60 is provided on the front of oven 10 in the conventional fashion and, as shown in FIGS. 3 and 6, a door 62 is also provided on the front of oven 10 also in the conventional fashion. Clearly, the combustion chambers and fan combination could have been relocated to the back wall of the oven cavity facing the door 62 if desired. The presence, however, of the "in-shot" vertical burners 14 and combustion chambers 38 which also are vertical allows for at least a 40 percent increase in oven rack capacity for a given oven height over a conventional design wherein, as noted above, the burner is disposed beneath the oven cavity and provision is made to circulate heated air from the burners around the oven cavity before entering the same. In the device of this invention, while a space may be provided beneath the oven cavity, between the cavity and the oven external shell or housing, clearly the products of combustion from burners 14 travel directly upwardly through the combustion chambers 38 and into the fan 12 through the back panel inlets 22. The mixed stream from the fan 12 then exits around the baffle plate 46 to enter the housing, and overpressure is relieved through a vent 30 into a flue (not shown).

The combustion chambers preferably are constructed of high temperature scale resistant stainless steel. These combustion chambers 38, however, could be fabricated from compressed mineral wool or ceramic fiber-type insulation or other refractory type materials. Any suitable high temperature, non-toxic insulation material could be used. An airwash could also be incorporated around the combustion chambers for thermal isolation, and this cooling air would be entrained with the flow of combustion gases entering the fan 12 through back plate 18.

The back draft provided by the single inlet centrifugal fan 12 is essential, as noted above, to complete combustion of the hot combustion products from the burners 14. The hole diameters and spacing pattern are determined by the required airflow necessary for complete combustion with the flueways. This is a relatively small flow rate compared to the recirculation flow rate within the oven cavity. For example, 30 cubic feet per minute (CFM) hot combustion air is typically mixed with 1050 CFM for recirculated oven cavity air. The required induced draft is independent of the centrifugal fan rotational speed which permits both low and high speed operation. For example, the fan can successfully operate at 1140 revolutions per minute (RPM) and 1725 RPM. Although a forward inclined blade-type centrifugal fan is a preferred design as shown herein, radial blade and backward inclined blade types could be utilized.

Figure 8:
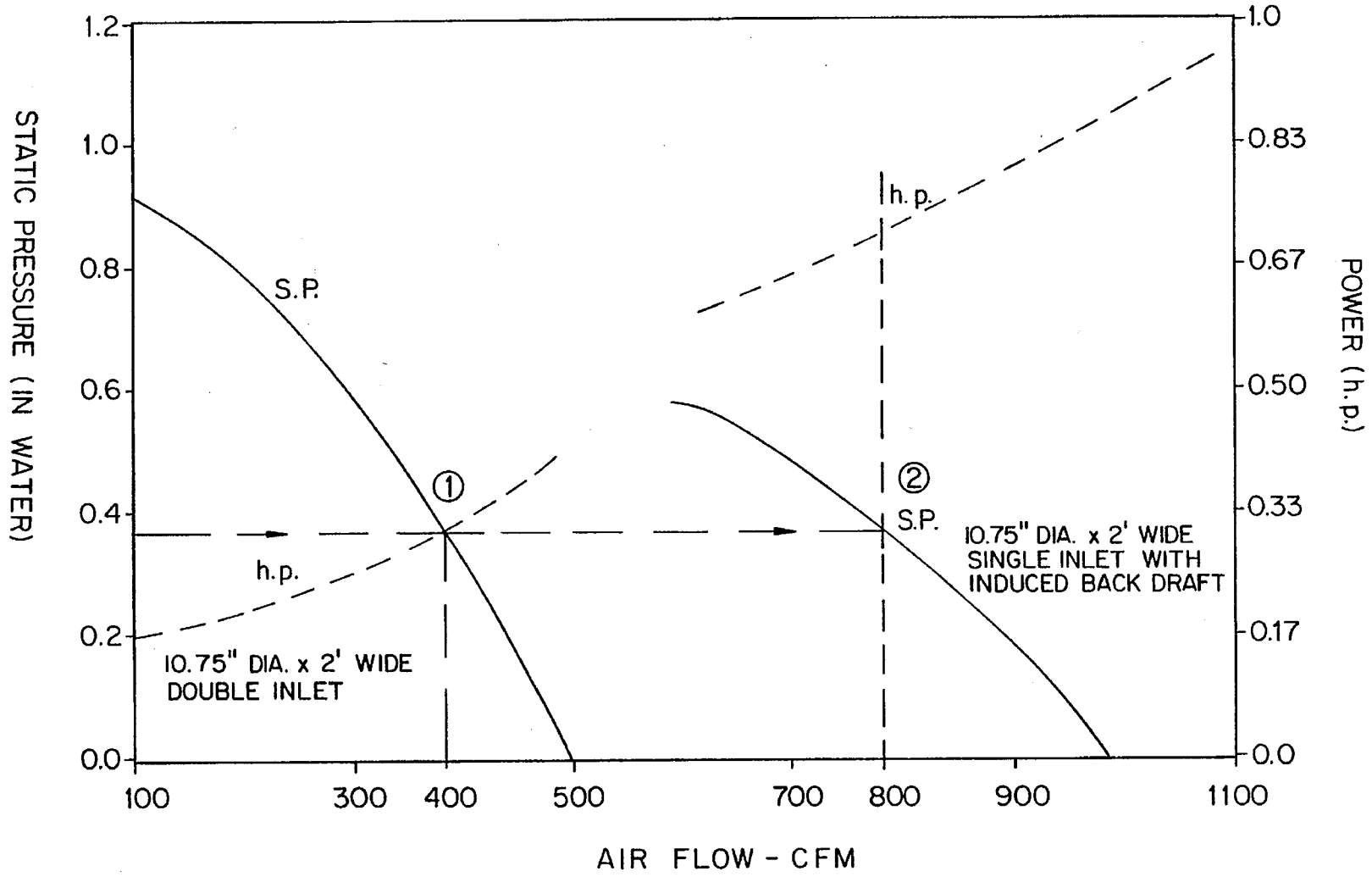
FIG. 8 is a graph depicting static pressure and horsepower required vs. the airflow for centrifugal fans having duel inlet or a single inlet with induced back draft.

With attention to FIG. 8, there is compared the characteristics of the single inlet induced back draft fan of this invention with the dual inlet fan used in, for example, U.S. Pat. Nos. 4,395,233 and 4,516,012 assigned to the assignee of this invention. The graph characterizes the static pressure and horsepower for each fan as compared to the airflow in cubic feet per minute. The two curves on the left represent the double inlet fan and the two curves on the right represent the single inlet with induced back draft fan of this invention.

For example, in the dual inlet fan the static pressure line crosses the horsepower of the fan at an air flow rate of about 400 CFM. This would then be close to normal operating conditions in that, as horsepower increases further, there is a dramatic dropoff in the static pressure generated. In contrast, a much higher airflow is generated by the single inlet back draft at similar static pressure. Furthermore, in order to generate a static pressure of about 0.4, the dual inlet fan would be operating at around 400 CFM whereas the single inlet fan would be operating in the area of around 800 CFM for identically sized fans.

It has been discovered that the number of air changes occurring within an oven cavity significantly influences the cooking quality and time in convection ovens. An air change is defined as the volume of air (CFM) delivered by the air moving impeller divided by the volume of usable oven cavity in cubic feet. Thus, a 10 cubic foot cavity with an air moving impeller delivering 1000 CFM would produce 100 air changes per minute.

Baked goods such as sheet cakes, breads and cookies have been found to require a maximum of 100 air changes per minute. An air change frequency greater than 110 changes per minute can result in surface imperfections, excessive moisture loss, and high shrinkage. Acceptable convection oven cooking performance is obtained when the frequency of air changes is maintained between 50 and 100 per minute. However, higher frequency air changes of 85 to 100 improve cooking performance.

The exception to this would be in very fluid mixtures which rapidly rise upon being heated such as muffins. However, even in this case, once the mixture is set and the center is no longer fluid, rapid heating through convection can be maintained.

Although the dual inlet centrifugal fan used in the "dual flow" convection oven was a significant improvement over conventional ovens, rapid air change frequency was limited because of space limitations imposed by acceptable overall physical dimensions of the centrifugal fan. The incorporation of a single inlet back draft induced centrifugal fan of the same size permits the direct inflow of combustion products and increases the air change frequency by a minimum of 50 percent while maintaining the existing impeller space allocation. It is possible to improve performance further by increasing the fan diameter within limitations. For example, an 8 percent diameter increase will cause a 4 percent airflow increase at zero static pressure.

Accordingly, the oven of this invention then provides for an increased rack capacity within an existing outside envelope substantially greater than prior art ovens primarily due to the use of vertical, "in-shot" burners and combustion chambers which eliminates both the space required for horizontal burners beneath the oven cavity and the heated airflow around the exterior of the oven cavity to heat the same.

In addition, the device of this invention provides with the same fan diameter, a greatly increased flow of combustion products to the interior of the oven cavity and, therefore, a greater number of air changes within the oven cavity so that air changes in the range of 85–100 per minute can be achieved.

The oven of this invention then utilizes a single inlet centrifugal fan with induced back draft coupled with in-shot vertical burners adjacent thereto to provide both a much more efficient cooking convection oven and to maximize the rack space available within an existing oven envelope by providing a constant flow of combustion products into the centrifugal fan to be mixed with a constant flow from the oven cavity for recirculation at relatively high volumes.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

We claim:

1. A forced air heating apparatus comprising:

an oven having vertical front and back walls, and right and left side walls, and horizontal top and bottom walls said walls forming an internal heating cavity, said top wall forming a vent communicating with said cavity, one of said vertical walls forming an inlet port and said front wall forming a door;

a plurality of vertically oriented elongated, upwardly opening combustion chambers disposed external to said wall forming an inlet port and adjacent thereto;

a plurality of vertically directed burners disposed in said combustion chambers adjacent said bottom walls;

a single inlet fan means with induced back draft, having an axial front inlet, rotatably mounted within said cavity adjacent the inlet port said fan means comprising a squirrel cage type fan having an open face and a concave back plate said back plate having a plurality of mutually spaced ports therein; and a vertical baffle plate disposed within said cavity adjacent said fan means having an inlet port in registration with said fan inlet and outlet ports adjacent said walls, so that during operation of said heating apparatus when said burners direct products of combustion upwardly through said chambers said products will be drawn down then through the wall inlet port into said fan as air from within said cavity is drawn through the baffle inlet into said fan which mixes the same and expels the mixture radially through the baffle outlet ports into said cavity.

2. The apparatus of claim 1 wherein two combustion chambers are provided, one disposed on each side of the wall inlet port.

3. The apparatus of claim 2 wherein a pair of "in-shot" burners are provided in each combustion chamber, adjacent the bottom wall of said oven.

4. The apparatus of claim 3 wherein said burners are interconnected by a common fuel manifold.

5. The apparatus of claim 1 wherein the wall inlet port is formed in one of said side walls.

6. The apparatus of claim 1 further comprising a plurality of mutually spaced blades surrounding the periphery of said fan and a mounting hub extending coaxially through said back plate, and a motor carried by said apparatus and operably coupled to said hub so that when said motor is coupled to a source of electric energy, it will rotatably drive said fan inducing a low pressure zone between said concave back plate and adjacent oven wall.

7. The apparatus of claim 6 wherein said fan will expel a volume of air into said cavity sufficient to replace the volume of air therein from 80–100 times per minute.

8. The apparatus of claim 1 wherein said fan means further comprises a forward inclined blade-type centrifugal fan wherein said blades are mounted between front and back rings and a circular, foraminous, concave back plate is mounted at its periphery to said back ring said plate mounting a coaxial hub; and external drive motor means coupled to said hub for driving said fan whereby air will be admitted axial through the front ring and through the holes in said back plate and expelled radially through said blades.

9. The apparatus of claim 8 wherein said fan will admit a flow of about 30 cubic feet per minute through said back plate and 1050 cubic feet per minute through said front ring simultaneously.

10. A method for maximizing the size of an oven cavity in a forced air cooking apparatus compared to the external dimensions of said apparatus comprising the steps of:

providing four vertical walls, a ceiling and a bottom defining said cavity with a vent in the ceiling and an inlet port in a vertical wall;

providing vertically directed burners and combustion chambers along the outside of a vertical wall adjacent the inlet port;

providing a single inlet fan within said cavity in front of the inlet port having a front axial inlet and a rear, concave, foraminous wall facing the inlet and baffle means extending between ceiling and bottom of said cavity in front of said fan having an inlet opening registering on said fan and outlet opening adjacent said walls;

igniting said burners and rotating said fan to draw products of combustion for said chambers through the holes in said back plate and air from within the cavity through the baffle inlet opening and expel the same through the baffle outlet openings.

* * * * *